United States Patent [19]

Klann

[11] 4,278,004

[45] Jul. 14, 1981

[54] PEDALBOARD

[76] Inventor: Paul A. Klann, P.O. Box 2398, Waynesboro, Va. 22980

[21] Appl. No.: 114,164

[22] Filed: Jan. 22, 1980

Related U.S. Application Data

[63] Continuation-in-part of Ser. No. 8,213, Jan. 31, 1979, abandoned.

[51] Int. Cl.[3] ..... G10C 3/14

[52] U.S. Cl. ..... 84/434; 84/227; 84/366; 84/426; 84/444

[58] Field of Search ..... 84/72–78, 84/225–232, 312 P, 353, 357–358, 366, 426, 433–435, 444

[56] References Cited

U.S. PATENT DOCUMENTS

| | | | |
|---|---|---|---|
| 748,378 | 12/1903 | Hughes | 84/433 |
| 1,070,512 | 8/1913 | Morenus | 84/225 |
| 2,466,511 | 4/1949 | Swanson | 84/434 |
| 3,616,722 | 11/1971 | Hochleitner | 84/434 |
| 4,043,244 | 8/1977 | Schrecongost et al. | 84/423 |

FOREIGN PATENT DOCUMENTS

| | | | |
|---|---|---|---|
| 3611 | of 1889 | United Kingdom | 84/433 |

*Primary Examiner*—Lawrence R. Franklin

*Attorney, Agent, or Firm*—Sughrue, Rothwell, Mion, Zinn and Macpeak

[57] ABSTRACT

Each key of the pedalboard is supported and guided for pivotal movement in a vertical plane by a steel strip secured to the underside of each key adjacent the mid-portion thereof. The rear end of each key is operatively connected to a transversely extending rear frame for horizontal reciprocating movement perpendicular to the rear frame and the forward end of each key is disposed between transversely extending upper and lower and front frame members for limited vertical movement therebetween. The forward end of each steel strip is secured to the lower front frame member to normally bias the forward end of each key into engagement with the upper front frame member.

13 Claims, 17 Drawing Figures

PEDALBOARD

CROSS REFERENCE TO RELATED APPLICATIONS

This application is a Continuation-In-Part application of application Ser. No. 8,213, filed Jan. 31, 1979, entitled "Pedalboard", now abandoned.

BACKGROUND OF THE INVENTION

1. Field of the Invention

The present invention is directed to pedalboards for organs and more specifically to a unique arrangement for supporting, biasing and guiding each key in the pedalboard.

2. Prior Art

It is old and well known in the organ industry to utilize a pedalboard wherein each key is pivotally mounted in the pedalboard frame on a fixed horizontal pivot axis. The opposite end of each key is guided for vertical movement by means of a vertically disposed pin secured to the frame and located in a bore or notch in the forward end of each key. A spring member such as an elastomeric block, a coil spring or a pneumatic tube is associated with the forward end of each key to bias the forward end of the key upwardly. Such supporting, guiding and biasing arrangements require a substantial number of individual parts thereby increasing the cost of the pedalboard not only in the cost of materials but also the cost of labor in assembling all of the parts together. Such support and guide arrangements are relatively rigid in their construction and are therefore noisy in operation and susceptible to breakage.

SUMMARY OF THE INVENTION

The present invention provides a new and improved pedalboard having a substantially reduced number of parts thereby substantially decreasing the cost of materials and labor in the construction of the pedalboard.

The present invention provides a new and improved pedalboard wherein the rear end of each key is guided for reciprocatory horizontal movement and the forward end of each key is supported, guided and biased by a single steel strip secured between the underside of each key and the transversely extending lower front frame member. The forward end of the key will only contact upper and lower felts secured to the upper and lower transversely extending front frame members to limit vertical movement and no lateral guide means are provided which would contact the forward end of each key. The absence of such lateral guide means provides for a far quieter operation of the pedalboard and eliminates all breakage problems previously associated with such lateral guide means.

According to the first embodiment of the present invention, each steel strip is extended rearwardly along the bottom of each key to the rear end thereof where it is bent downwardly at right angles and secured to the transversely extending rear frame member. Thus, the single steel strip secured to the undersurface of each key provides a sole support for each key. Upon depression of the forward end of a key against the spring force of the steel strip, the rear end of the key will oscillate slightly about the connection of the steel strip to the rear frame member. Thus, the key is free from contact with all frame structure except for the felts which limit the vertical movement of the forward end of the key.

According to the second embodiment of the present invention, the rear end of each key is guided for horizontal reciprocating movement in the direction of the length of the key by guide means secured to the transversely extending rear frame member of the pedalboard. The guide means are provided with relatively close tolerances to prevent twisting of the keys about their longitudinal axis and the guide means may be suitably lubricated to facilitate a quiet sliding operation.

According to a third embodiment of the present invention an L-shaped plastic fitting is secured to the rear end of each key with the horizontally disposed portion slidably located in a laterally open, horizontally extending slot in the rear frame member. Thus, upon depression of the front end of the key the yieldability of the plastic fitting will allow the rear end of the key to oscillate slightly about the horizontal portion of the plastic fitting similar to the first embodiment.

The present invention provides a new and improved pedalboard construction which is quieter in operation and which provides a far superior touch than previous pedalboard constructions. As a result of the relatively free reciprocating or oscillating mounting arrangement for the rear end of each key, the key may be depressed with a substantially constant force as opposed to previous designs wherein the force necessary for downward movement of a key increased due to increased spring pressure when the key was pivoted about a fixed pivot axis. Such a constant pedal force is very desirable to an organist and approaches what is well known in the industry as tracker touch which heretofore was never available in pedalboards.

The present invention provides a new and improved pedalboard for organs which is lighter and less cumbersome since the pedalboard can have a lower profile due to the absence of vertical guide pins for the individual keys.

The present invention also provides a new and improved fastener for securing the keys to the spring strips in a manner which will allow for expansion and contraction of the wood keys without the loss of holding power.

The foregoing and other objects, features and advantages of the invention will be apparent from the following more particular description of preferred embodiments of the invention as illustrated in the accompanying drawings.

DETAILED DESCRIPTION OF THE INVENTION

Figures 1, 2, 3, 4, 5, 6, 7:
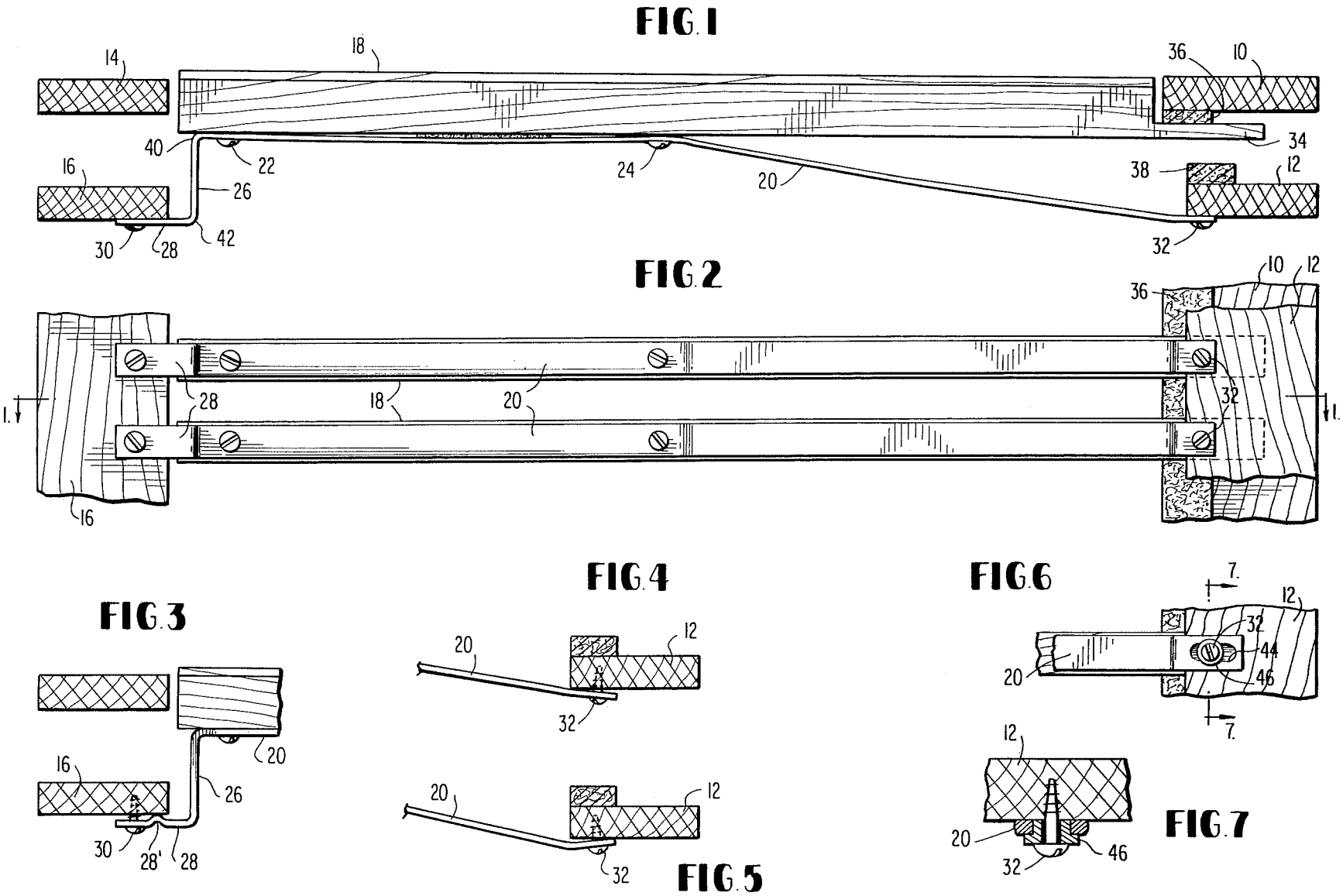
FIG. 1 is a sectional view of a pedalboard according to the present invention taken along the line 1—1 of FIG. 2.
FIG. 2 is a partial bottom plan view of a pedalboard according to the present invention.
FIG. 3 is a partial sectional view showing a modified connecting arrangement for the left end of the key as viewed in FIG. 1.
FIG. 4 is a partial sectional view showing a modified connecting arrangement for the right end of a key as viewed in FIG. 1.
FIG. 5 is a partial sectional view showing a further modification of a connecting arrangement for the right end of a key as shown in FIG. 1.
FIG. 6 is a partial plan view showing a modified connecting arrangement for the right end of the key as viewed in FIG. 2.
FIG. 7 is a sectional view taken along the line 7—7 in FIG. 6.

Since the present invention relates to the manner of mounting individual keys in a pedalboard an entire pedalboard has not been illustrated but it is obvious that the pedalboard could be a conventional 32-key pedalboard having front and rear frame members which extend substantially perpendicular to the keys. A portion of such a pedalboard is illustrated in the drawings and includes transversely extending upper and lower front frame members 10 and 12, respectively. The pedalboard also includes transversely extending upper and lower rear frame members 14 and 16, respectively. For purposes of illustration, two keys 18 have been illustrated in FIG. 2 and the various mounting arrangements for such keys will be described hereinafter only with respect to the single key. Although the key 18 as illustrated is a natural, the mounting arrangement is identical for naturals and sharps.

As best shown in FIGS. 1 and 2, an elongated resilient strip 20 of spring steel or any other suitable material is secured to the undersurface of the key 18 by means of two screws 22 and 24. The screw 22 is located adjacent the rear end of the key and the screw 24 is disposed substantially at the midpoint of the key. The rear end of the support strip 20 is bent downwardly at right angles to the key to define a hinge portion 26 and is then bent in the opposite direction at right angles to define an attachment portion 28 which is secured to the lower rear member 16 by means of screw 30. The support strip 20 diverges downwardly from the key 18 forwardly of the attachment screw 24 and the forward end of the support strip 20 is secured to the lower front frame member 12 by means of screw 32. A forward end portion 34 of the key 18 extends between the upper and lower frame members 10 and 12 and is adapted to move in a vertical plane between felts 36 and 38 secured to the upper and lower frame members 10 and 12, respectively. The support strip 20 acts as a spring which normally biases the key 18 upwardly into engagement with the felt 36 on the upper front frame member 10.

In operation of th key according to the arrangement shown in FIGS. 1 and 2, the organist would depress the forward end of the key 18 by pressing downwardly thereon to bring the forward end of the key into contact with the lower felt 38. Suitable switch means, which are not shown since they do not form a part of the present invention, may be secured to the forward end of the key to provide the necessary control function for the organ. Since the forward end of the support strip 20 which acts as the return spring for the key 18 is secured in a fixed manner to the frame, the downward movement of the forward end of the key will necessarily result in a rearward displacement of the rear end of the key. The hinge portion 26 of the support strip 20 will pivot about the two right angular bends in the strip 20 so that the point 40 will oscillate relative to the point 42. Suitable clearance is provided between the rear end of the key 18 and the frame member 14 so that the only contact the key 18 will make with any portion of the frame structure will be through the felts 36 and 38 which are secured to the forward frame members.

In FIG. 3, a modified connecting arrangement for the rear end of the support strip 20 is shown wherein the attachment portion 28 is provided with a projection 28' which will space the attachment portion 28 from the lower rear frame member 16. Depending upon how close the securing screw 30 draws the attachment portion 28 toward the frame member 16, the pivotal characteristics of the hinge portion 26 of the support strip 20 will be modified to vary the touch characteristic of the key operation.

Similar modifications may be provided with respect to the attachment of the forward end of the support strip 20 to the lower front frame member 12 as shown in FIGS. 4 and 5. In FIGS. 4 and 5, the forward end of the support strip 20 is bent at such an angle that it will not normally lie flat against the undersurface of the lower frame member 12. Thus, the degree of tightening applied to the screw 32 will vary the force characteristics associated with the support strip to vary the touch of the key.

In the modification shown in FIGS. 6 and 7 the support strip 20 is provided with an elongated slot 44 at the forward end and the screw 32 extends through a flanged guide sleeve 46 which is inserted into the slot 44. Upon depression of the pedal 18, forward end of the support strip 20 will reciprocate back and forth in the restraints provided by the guide sleeve 46. Such compensating movement of the support strip 20 can either supplement or replace the hinged compensating movement at the opposite end as shown in FIGS. 1-3.

Figure 8:
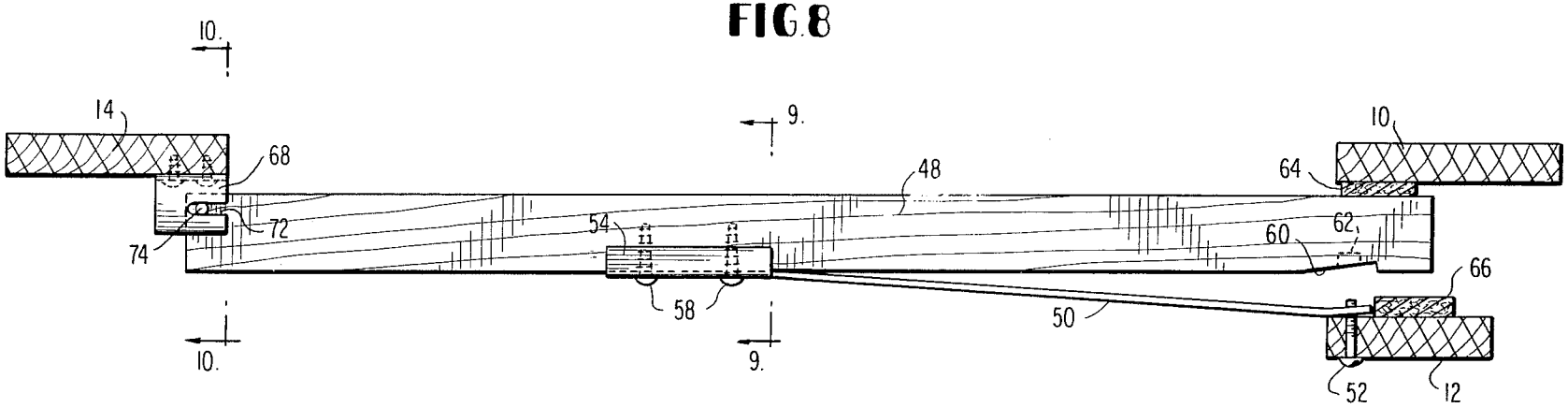
FIG. 8 is a sectional view of a pedalboard similar to FIG. 1 showing a second embodiment according to the present invention.
Figure 9:
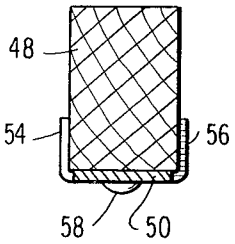
FIG. 9 is a sectional view taken along the line 9—9 of FIG. 8.
Figure 13:
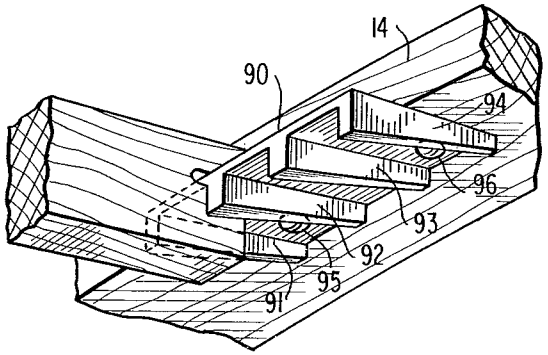
FIG. 13 is a perspective view showing a further modified supporting arrangement for supporting the rear end of a plurality of keys.

In a second embodiment according to the present invention, a key 48 is provided with a support strip 50 of spring steel or the like which is secured at the forward end to the lower front frame member 12 by means of screw 52. The opposite end of the support strip 50 is provided with a pair of turned up flanges 54 and 56 which define a U-shaped channel adapted to closely embrace the bottom and portions of opposite sides of the key 48. The U-shaped channel portion of the support strip 50 is secured to the key by means of screws 58. By turning the screw 52 the proximity of the bent end portion of the support strip 50 relative to the front frame member 12 may be adjusted to vary the force characteristics of the strip 50 which acts as a return spring for the key 48. Suitable recesses 60 and 62 may be provided in the lower surface of the key 48 adjacent the forward end to accommodate the forward end of the strip 50 and the end of the screw 52 without actually making contact. Thus, during vertical movement of the key 48 the forward end thereof will only engage the felts 64 and 66 secured to the upper and lower frame members 10 and 12, respectively. As a modification which would eliminate the necessity for the recesses 60 and 62, the forward end of the support strip 50 may be secured to the lower surface of the frame member 12 in the manner shown in either FIG. 4 or FIG. 5. The location of the forward end of the support strip 50 as shown in FIG. 8 helps to reduce the overall height of the pedalboard. The elimination of the vertical guide pins for guiding the forward end of the key as discussed above with respect to the prior art construction also contributes to a substantial reduction in overall height of the pedalboard.

Figure 10:
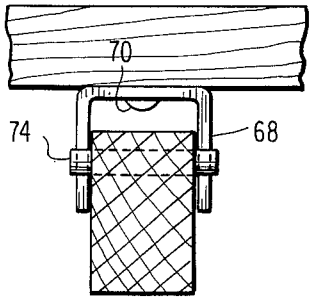
FIG. 10 is a sectional view taken along the line 10—10 of FIG. 8.

The rear end of the key 48 as shown in the embodiment of FIGS. 8–12 is supported for horizontal reciprocating sliding movement as opposed to the oscillatory movement in the embodiment of FIGS. 1–7. As shown in FIGS. 8 and 10 an inverted U-shaped bracket 68 is secured to the undersurface of the transversely extending upper rear frame member 14. Each leg of the inverted U-shaped bracket 68 is provided with a forwardly open, horizontally extending slot 72. A pin 72 extends through the end of the key 48 and protrudes outwardly on opposite sides. The protruding end portions of the pin 47 are guided for sliding movement in the slots 72. The pin 74 may be plastic, metal or any other suitable material and the tolerances between the pin and slots should be fairly close to prevent any twisting movement of the key about its longitudinal axis which would lead to rattling of the pin within the slot.

Figure 12:
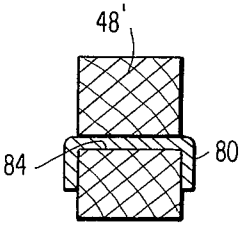
FIG. 12 is a sectional view taken along the line 12—12 in FIG. 11.
Figure 11:
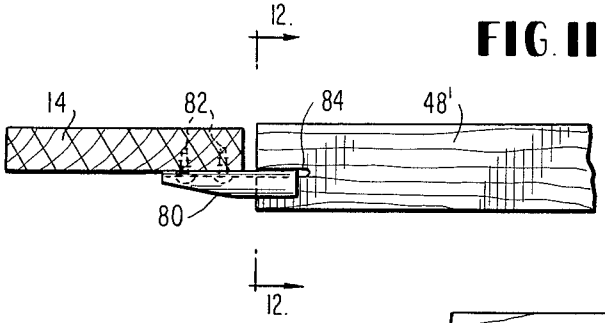
FIG. 11 is a partial sectional view showing a modified supporting arrangement for the left end of a key as shown in FIG. 8.

A modified slot and complimentary projection arrangement is shown in FIGS. 11 and 12 wherein an inverted U-shaped bracket 80 is secured to the undersurface of the upper rear frame member 14 by means of screws 82. A rearwardly open horizontal slot 84 is formed in the end of the key 48'. The bracket may be formed of metal, plastic or any other suitable material and is so dimensioned relative to the slot 84 as to have a relatively tight sliding engagement. In order to facilitate the sliding engagement, the slot 84 may be lubricated. The legs of the inverted U-shaped bracket prevent lateral movement of the key and the close tolerances of the bracket within the slot prevent any twisting movement of the key 48' about its longitudinal axis. In this way the sliding operation of the key is completely smooth and silent.

Since the keys in the standard 32 key pedalboard are grouped from one side of the pedalboard to the other in groups of three, five, seven, five, seven and five, a single bracket may be utilized to accommodate a group of keys having a specific number of keys therein. In the examples shown in FIG. 13 the bracket 90 which is secured to the undersurface of the upper rear frame member 14 is provided with four equally spaced downardly extending flanges 91, 92, 93 and 94. A sliding key similar to that shown in FIG. 11 is located between each pair of adjacent flanges so that this particular bracket can accommodate a group containing three keys. Similar brackets are provided for the groups containing five and seven keys, respectively. Each of the multiple key brackets is secured to the associated frame member by means of two screws 95 and 96 which may be located in the two outer most channels defined by the depending flanges. By using the multiple key brackets the assembly time is substantially reduced since it is not necessary to secure a U-shaped bracket to the frame member for each key. The arrangements as shown in FIGS. 8–13 also facilitate the assembly time of the keys in the pedalboard since each key is only secured to the pedalboard frame by a single screw, that is, the screw 52 which secures the forward end of the support strip 50 to the frame member 12.

Figures 14, 15, 16, 17:
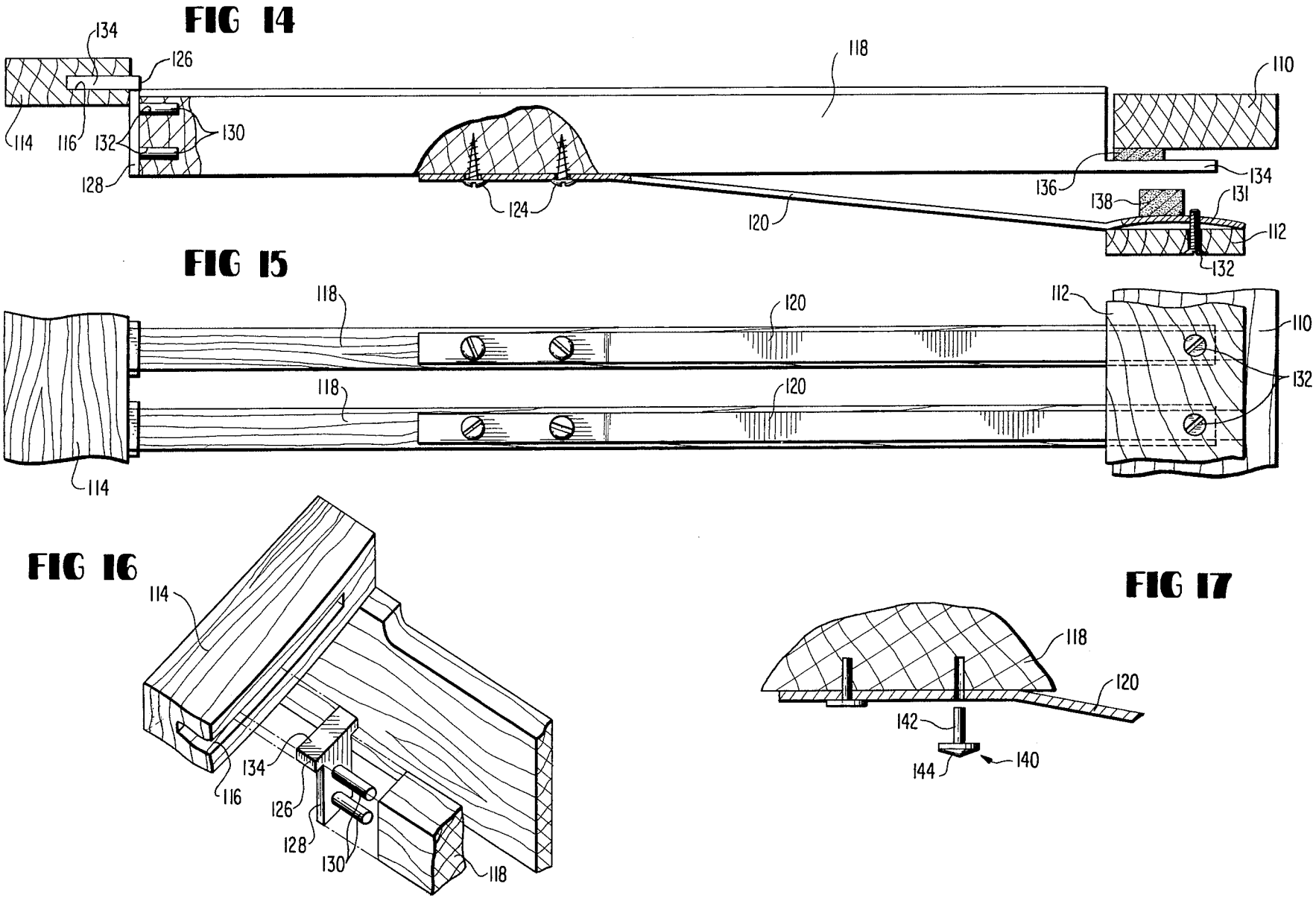
FIG. 14 is a sectional view of a pedalboard similar to FIG. 1 showing a third embodiment according to the present invention.
FIG. 15 is a partial bottom plan view of the pedalboard as shown in FIG. 14.
FIG. 16 is a partial exploded perspective view of a rear corner of the pedalboard according to FIG. 14.
FIG. 17 is a partial sectional view of a key showing a fastener detail.

In a third embodiment according to the present invention as illustrated in FIGS. 14–16, each key 118 is similar to the key 18 of the embodiment of FIG. 1 with a forward end portion 134 extending between the upper and lower frame members 110 and 112, respectively. A support strip 120 is secured to the bottom of each key by a pair of screws 124 adjacent the rear end of the strip. The forward end of the strip 120 is provided with an arcuate portion 131 which is adjustably secured to the lower frame member 112 by means of screw 132. A felt 136 is secured to the lower surface of the upper frame member and a second felt 138 is secured to the upper surface of the arcuate portion 131. The response of the key may be adjusted by screw 132. By turning the screw 132 in a direction to draw the curved portion toward the lower support frame the upward pressure of the support 120 on the key will be increased to provide more resistance to foot pressure.

The rear frame member 114 is provided with a laterally open slot 116 which extends substantially the entire length of the frame member. An L-shaped fitting 126, preferably of plastics material, is secured to the rear end of each key 118. The vertical portion 128 of the fitting 126 is provided with a pair of projections 130 which extend into corresponding recesses 132 in the end of the key. The fitting is preferably secured to the key by means of an adhesive and in addition to their locating function, the projections 130 provide additional surface area for the adhesive. The horizontal portion 134 of the fitting 126 which is wider than the key is located in the slot 116 with very close tolerances to provide a snug sliding fit to prevent rattling. No other securing means are necessary and the wide horizontal portion properly spaces the keys. Upon depression of a key the fitting 126 reciprocates slightly in slot 116 and will also flex slightly to effectively pivot the end of the key on the rear frame member.

A modified form of a fastener is shown in FIG. 17 for connecting the support 120 to the key 118. Each fastener 140 is provided with a cylindrical stem 142 and a head portion 144 which is bent downwardly toward the stem on opposite sides thereof. The fastener may be of metal or plastic and the head may be a bar, two crossed bars or conical. Upon forcing the fastener into a smooth hole and cementing the fastener therein with the head flat, increased holding power can be provided. The flattening of the head creates a tension between the wood key 118 and the spring support 120 which allows expansion and contraction of the wood key without loss of holding power.

The support strip in the various embodiments may be of spring steel, plastic or any other suitable, flexible, resilient material. The strip has a width approximately equal to the width of the key but may be slightly narrower as shown in FIG. 2 or slightly wider.

While this invention has been described in detail and with reference to specific embodiments thereof, it will be apparent to one skilled in the art that various changes and modifications can be made therein without departing from the spirit and scope thereof.

What is claimed is:

1. A pedalboard for an organ comprising front and rear frame means, at least one key disposed between said front and rear frame means, combined support and return spring means for supporting said key in said pedalboard and normally biasing said key into an elevated position comprising an elongated resilient support strip secured to the undersurface of said key substantially adjacent the midportion thereof, said strip diverging downwardly away from said key with the front end of said strip being disposed in spaced vertical alignment with the front end portion of said key, first connecting means securing the forward end of said strip to said front frame means and second connecting means operatively connecting the rear end of said key to said rear frame means for substantially horizontal movement of the rear end of said key in opposite directions along the length of said key.

2. A pedalboard as set forth in claim 1, wherein said first connecting means is adjustable to vary the spring characteristic of said resilient support strip.

3. A pedalboard as set forth in claim 2, further comprising cushion means on said front frame means and recess means in the undersurface of the front end portion of said key to prevent contact of said key with said front frame means and said first connecting means.

4. A pedalboard as set forth in claim 1, wherein said first connecting means is comprised of a lost motion means allowing limited reciprocating movement of the front end of said strip as the front end of said key is depressed and elevated.

5. A pedalboard as set forth in claim 1, wherein said resilient support strip extends rearwardly along the undersurface of said key and is provided with a first downwardly extending bent portion and a second rearwardly extending bent portion, said second bent portion being connected to said frame by said second connecting means whereby the rear end of said key may move rearwardly and forwardly upon depression and elevation of the forward end of said key due to the bending action of said first bent portion relative to said strip and said second bent portion.

6. A pedalboard as set forth in claim 1, wherein said second connecting means is comprised of horizontal slot means operatively associated with one of said rear frame means and said key and horizontal projection means operatively associated with the other of said rear frame means and said key and slidably disposed in said horizontal slot means for reciprocating movement upon depression and elevation of the front end of said key.

7. A pedalboard as set forth in claim 6 wherein an inverted U-shaped bracket is secured to the rear frame means and is provided with forwardly open horizontal slots in each downwardly extending portion of the bracket and pin means extending outwardly from opposite sides of said key into said slots for sliding movement therein.

8. A pedalboard as set forth in claim 6, wherein an inverted U-shaped bracket is secured to and extends forwardly of said rear frame means and a rearwardly open horizontal slot is located in the end of said key for slidably receiving the horizontal portion of said inverted U-shaped bracket therein.

9. A pedalboard as set forth in claim 6, wherein a plate having a plurality of downwardly extending spaced apart flanges is secured to and extends forwardly of said rear frame means and a rearwardly open horizontal slot located in the end of each key for slidably receiving the horizontal portion of said plate between an adjacent pair of downwardly extending flanges.

10. A pedalboard as set forth in claim 1, wherein said rear frame means is provided with a slot extending substantially the entire length thereof and said second connecting means is comprised of an L-shaped fitting secured to the end of said key with one leg thereof extending into said slot for slidable supporting movement therein.

11. A pedalboard as set forth in claim 10, wherein said fitting is flexible to allow privotal movement of the end of said key about the leg of said bracket disposed in said slot.

12. A pedalboard as set forth in claim 1, wherein the forward end of said strip is provided with an arcuate portion with both ends of said arcuate portion resting on said front frame member and said first connecting means is comprised of a screw extending through said front frame means into threaded engagement with said arcuate portion for drawing said arcuate portion closer to said front frame means to increase the spring force on said key.

13. A pedalboard as set forth in claim 1, wherein said resilient support strip is secured to said key by fastener means having a straight shank and a head angled toward said shank on opposite sides thereof so that upon adhesively securing said shank in a hole in said key and said strip with said head flattened a tension will be created between said key and said strip which allows expansion and contraction of the wood key without loss of holding power.

* * * * *